US009938068B2

(12) United States Patent
Li

(10) Patent No.: US 9,938,068 B2
(45) Date of Patent: Apr. 10, 2018

(54) COOLER/LUNCH BAG WITH DETACHABLE LINER

(71) Applicant: Richard Qi Li, Ocala, FL (US)

(72) Inventor: Richard Qi Li, Ocala, FL (US)

( * ) Notice: Subject to any disclaimer, the term of this patent is extended or adjusted under 35 U.S.C. 154(b) by 604 days.

(21) Appl. No.: 13/682,735

(22) Filed: Nov. 21, 2012

(65) Prior Publication Data

US 2014/0140643 A1 May 22, 2014

(51) Int. Cl.

| | |
|---|---|
| ***A45C 11/20*** | (2006.01) |
| ***B65D 81/38*** | (2006.01) |
| ***A45C 3/04*** | (2006.01) |
| ***A45C 9/00*** | (2006.01) |
| ***A45C 13/02*** | (2006.01) |

(52) U.S. Cl.

CPC ..... *B65D 81/3893* (2013.01); *A45C 3/04* (2013.01); *A45C 9/00* (2013.01); *A45C 11/20* (2013.01); *A45C 13/02* (2013.01); *A45C 2009/007* (2013.01); *A45C 2013/026* (2013.01)

(58) Field of Classification Search

CPC ..... A45C 3/04; A45C 3/08; A45C 7/0086; A45C 7/009; A45C 11/20; A45C 13/1092; A45C 2009/007; A45C 13/002; B65F 1/062

USPC ..... 220/592.15, 592.23, 592.24, 495.03, 220/495.05, 495.06, 495.08, 495.1, 220/495.11; 383/4, 111, 119, 121; 150/103–105, 113

See application file for complete search history.

(56) References Cited

U.S. PATENT DOCUMENTS

| | | | | |
|---|---|---|---|---|
| 4,453,623 | A * | 6/1984 | Horii | 190/102 |
| 6,557,716 | B1 * | 5/2003 | Chan | 220/9.4 |
| 7,461,676 | B2 * | 12/2008 | Huie | 150/105 |
| 2002/0038745 | A1 * | 4/2002 | Lamming | 190/125 |
| 2003/0024960 | A1 * | 2/2003 | Greenstein et al. | 224/153 |
| 2007/0289681 | A1 * | 12/2007 | Bond | A45C 13/08 150/104 |
| 2008/0011754 | A1 * | 1/2008 | Ramsey | 220/495.06 |
| 2012/0181210 | A1 * | 7/2012 | Shi | B65D 5/643 206/524.8 |
| 2013/0037185 | A1 * | 2/2013 | Hubbell | A45C 3/08 150/106 |

* cited by examiner

*Primary Examiner* — Jes F Pascua
*Assistant Examiner* — Nina Attel

(57) ABSTRACT

A cooler/lunch bag has a detachable liner, which is attached to the bag by engaging a row of round studs on the bag with a row of "+" shaped slits in the liner. After the liner is detached, it can be folded up, inverted and covered by its plastic base in a storage position. Such cooler/lunch bag can be thoroughly cleaned and is suitable for long-term use, in contrast to the cooler/lunch bags with fixed liners, which become disposable when soiled.

1 Claim, 4 Drawing Sheets

COOLER/LUNCH BAG WITH DETACHABLE LINER

BACKGROUND OF INVENTION

The currently available lunch bags or cooler bags are made with a liner, which is fixed and is not waterproof. When there is a spill inside of it, much of the bag can be stained and soiled and then the bag can not be cleaned thoroughly, because it is impossible to clean the layer between the liner and the exterior of the bag. If the liner is damaged, it can not be replaced and the bag is rendered useless. Because of the fact that lunch bags get dirty easily and can not be cleaned well and that the fixed liner can not be replaced once it is broken, lunch bags are deemed disposable items. For these reasons, lunch bags are made with cheap material and shoddy craftsmanship. Some lunch bags are made with fashionable designs and appear artistic, but it is a pity that unfortunately they are discarded sooner or later after they become too dirty to use. Because of the fixed liner, the cooler bags and lunch bags are only dedicated to their intended use and can not be applied to other usage.

I have designed a cooler bag/lunch bag with a detachable liner, which confers a dual use both as a cooler/lunch bag and a usual carry/shopping bag. When the liner is detached and folded up on the bottom of the bag, the cooler/lunch bag is converted to a carry/shopping bag. The liner can be made in different shape to fit in bags of different shapes.

The detachable liner is made of a complete piece of plastic, silicone or rubber is thus waterproof. The liner can be removed, cleaned or repaired and the cooler/lunch bag can be machine-washed too. The liner can be replaced whenever it is damaged. This design allows the cooler/lunch bags to be maintained in good condition easily and makes the long-term use possible. Therefore, better materials, designs and craftsmanship are worthwhile for such cooler/lunch bags.

SUMMARY OF INVENTION

The convertible cooler/lunch bag of my design features a unique liner which is made of a complete piece of waterproof material such as a sheet of plastic, rubber or silicon without any stitch. It has a row of "+" shaped slits along its top margin which correspond to a row of round studs along the top margin of the cooler/lunch bag and snap onto them to get attached to the interior of the bag. The upper slit may straddle the narrow neck of the stud. The liner is attached to its base, which has two longitudinal side walls and is attached to interior of the bag with hook and loop patches on its side walls. The liner is only adhered to its base, not to the two free side walls. The bag functions as a cooler/lunch bag when the liner is attached this way. When the cooler/lunch bag is to be used as a usual carry bag, the liner can be easily detached from the bag by disengaging its "+" shaped slits from studs on the bag, rolled up around the axis formed by its top margin and pressed into the base. Then the base, which now contains the folded liner, is inverted, so that its bottom surface functions as a bottom of the carry bag while the base is immobilized and attached to interior of the bag by means of the hook and loop patches on its two side walls.

DETAILED DESCRIPTION OF THE INVENTION

Figure 1:
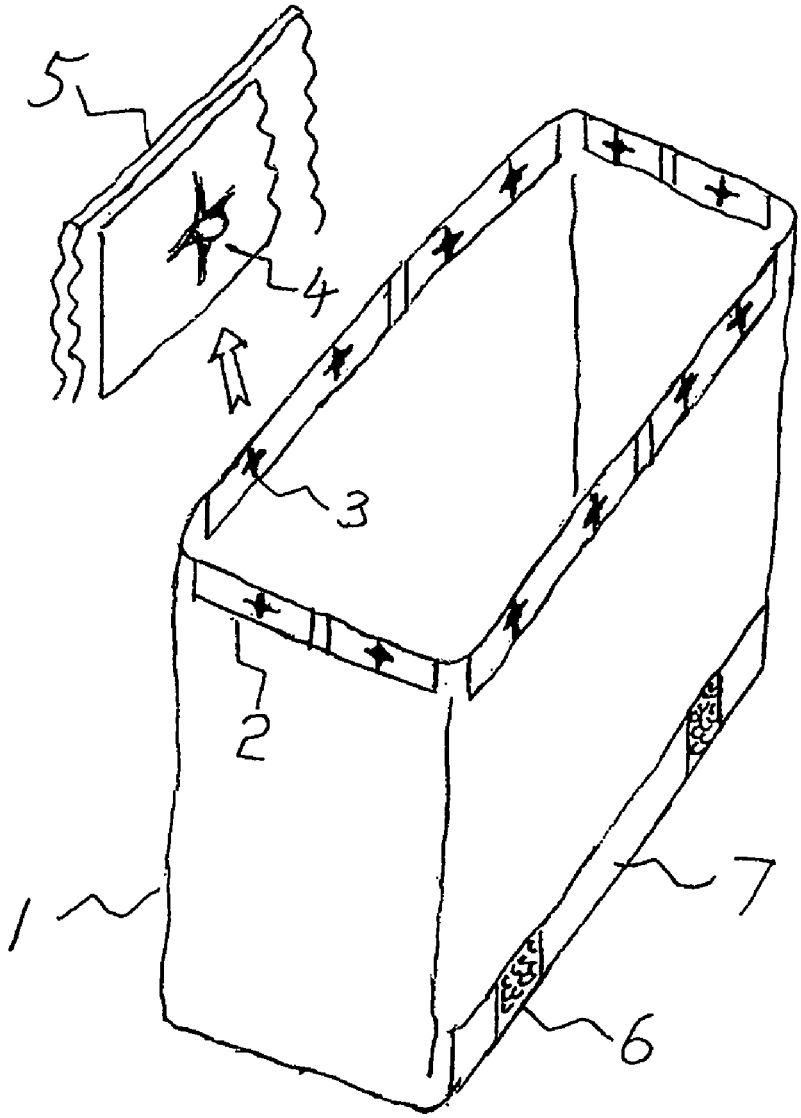
FIG. 1 shows the liner is fully open and is attached to the cooler/lunch bag by snapping the studs on the bag into the slits in the liner.

FIG. 1 demonstrates a fully opened cooler/lunch bag liner 1. Its top margin is reinforced with several thin plastic strips 2, which have "+" shaped slits 3. The "+" shaped slits correspond to a row of round studs 4 on the top margin of the cooler/lunch bag 5 and snap onto them so as to attach the liner to the interior of the bag.

The liner has a plastic base 7, which has two longitudinal side walls. The lower part of the liner is immobilized and is attached to the interior of the bag by means of hook and loop patches 6 on the side walls of its base.

Figure 2:
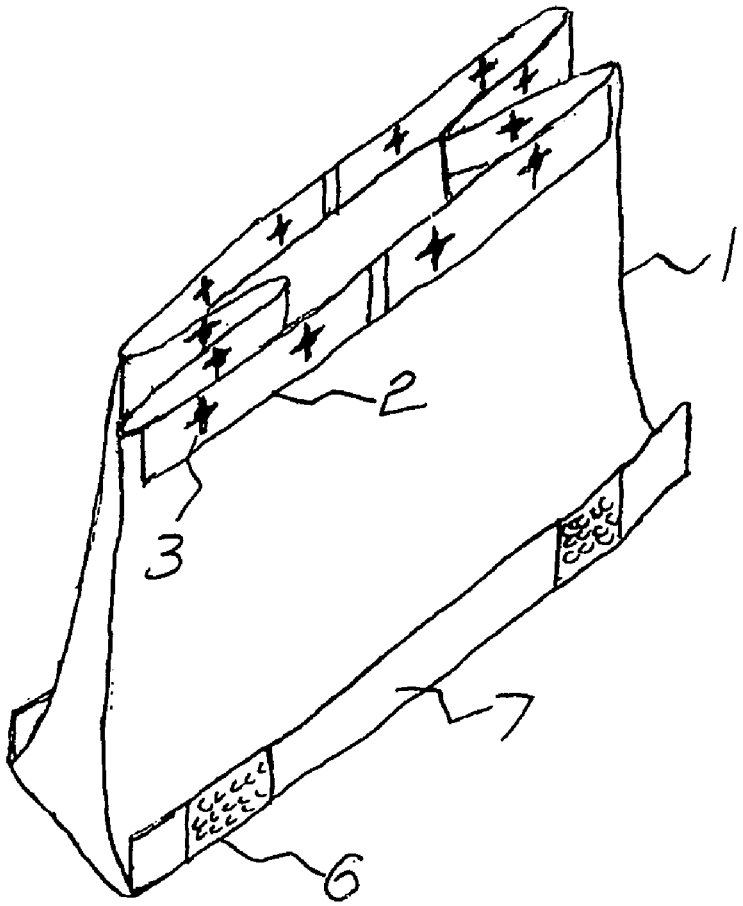
FIG. 2 shows the liner is detached from the cooler/lunch bag and is partially closed.

FIG. 2 demonstrates the folding process of the liner 1. First, the liner 1 is closed when its opening is folded at the soft spots between the reinforcing plastic strips 2. FIG. 2 also demonstrates that the liner is only adhered to the bottom part of its base 7, not to the two free side walls.

Figure 3:
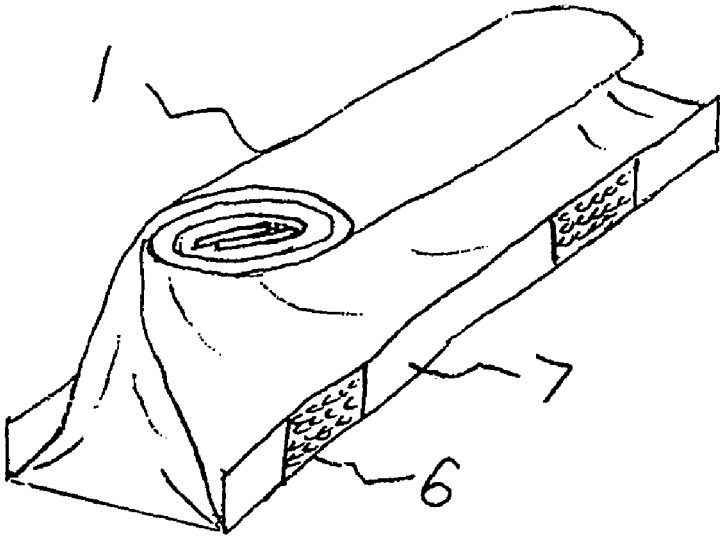
FIG. 3 shows the liner is in the process of being folded and is to be placed in its base.

FIG. 3 demonstrates next step of the folding process. The liner 1 is being folded up around the axis formed by its upper margin which has the reinforcing strips 2 and is to be placed in its base 7.

Figure 4:
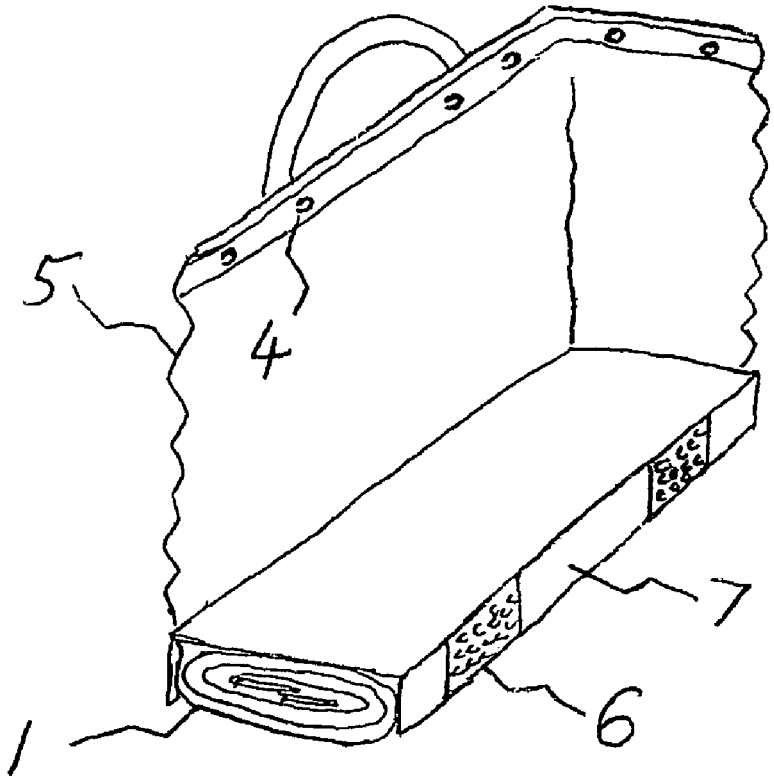
FIG. 4 shows the base of the liner with two longitudinal walls which contains the folded liner and is inverted to function as the bottom of the cooler/lunch bag

FIG. 4 demonstrates the base of the liner 7, which is inverted and contains the folded liner 1. With the liner detached, the cooler/lunch bag is converted to a carry bag/shopping bag. The base 7 is immobilized and attached to the interior of the bag 5 by means of hook and loop patches 6 on its two side walls. The bottom of the inverted base now functions as the base of the carry bag/shopping bag. It also demonstrates a row of round studs 4 on a strip on the top margin of the bag.

What is claimed:

1. A convertible cooler/lunch bag, comprising: a bag and a detachable liner; the bag having a top margin comprising a plurality of round studs on a strip and the detachable liner having a top margin comprising a plastic strip with a plurality of "+" shaped slits that correspond to and engage the plurality of round studs, wherein the detachable liner is attached to an interior of the bag by the corresponding plurality of "+" shaped slits and plurality of round studs; the detachable liner having a base comprising two longitudinal side walls, wherein a bottom part of the detachable liner is attached to the base, wherein the detachable liner is free of attachment to the longitudinal side walls and wherein the longitudinal side walls are attached to the interior of the bag by hook and loop fastener strips; and the base being configured to store the detachable liner in a storage position after the detachable liner has been detached from the interior of the bag and inverted, wherein the detachable liner is folded and covered by the base in the storage position, wherein the longitudinal side walls are attached to the interior of the bag by hook and loop fastener strips in the storage position and wherein a bottom of the base becomes a base of the bag in the storage position.

* * * * *